US006427654B2

(12) United States Patent
Golbach et al.

(10) Patent No.: US 6,427,654 B2
(45) Date of Patent: Aug. 6, 2002

(54) DEVICE FOR CHANGING THE CONTROL TIMING OF THE GAS EXCHANGE VALVES OF AN INTERNAL COMBUSTION ENGINE, IN PARTICULAR A HYDRAULIC CAMSHAFT ADJUSTMENT DEVICE OF THE ROTARY PISTON TYPE

(75) Inventors: Hermann Golbach, Erlangen; Martin Steigerwald; Jens Schäfer, both of Herzogenaurach; Matthias Kapp, Hemhofen; Joachim Dietz, Frensdorf, all of (DE)

(73) Assignee: Ina Walzlager Schaeffler oHG (DE)

( * ) Notice: Subject to any disclaimer, the term of this patent is extended or adjusted under 35 U.S.C. 154(b) by 0 days.

(21) Appl. No.: 09/746,218

(22) Filed: Dec. 22, 2000

(30) Foreign Application Priority Data

Dec. 24, 1999 (DE) ..... 199 63 094

(51) Int. Cl.[7] ..... F01L 1/344

(52) U.S. Cl. ..... 123/90.17; 123/90.37; 123/90.65; 74/568 R; 464/2

(58) Field of Search ..... 123/90.15, 90.17, 123/90.31, 90.37, 90.65; 74/568 R; 464/1, 2, 160

(56) References Cited

U.S. PATENT DOCUMENTS 5,813,378 A * 9/1998 Sato ..... 123/90.17
6,032,626 A * 3/2000 Haag ..... 123/90.17
6,173,688 B1 * 1/2001 Fukuhara et al. ..... 123/90.17
6,289,862 B1 * 9/2001 Schafer et al. ..... 123/90.17

FOREIGN PATENT DOCUMENTS

EP 0807746 A1 11/1997
EP 0818610 A2 1/1998

* cited by examiner

*Primary Examiner*—Weilun Lo
(74) *Attorney, Agent, or Firm*—Volpe and Koenig, P.C.

(57) ABSTRACT

A hydraulic camshaft-adjusting device of the rotary piston type that includes of a drive gear (2) directly connected to a crankshaft and an impeller that is directly connected to a camshaft (3). The drive gear (2) has a cavity formed from a perimeter wall (5) and two side walls (5, 6) inside of which at least one hydraulic working chamber is formed from at least two boundary walls. The impeller has at least one radial vane (12) and each vane (12) divides one hydraulic work chamber into two hydraulic pressure chambers. The outer end (18) of each vane (12) of the impeller is pressed radially against the perimeter wall (5) of the drive gear (2) as a result of the force of a spring element (17) located at the inner end (15) of the vane. The spring elements (17) located at the inner end (15) of the vanes (12) have, at unchanged space requirements, a spring force that is greater than the pressure force of the hydraulic pressure medium acting on the outer end (18) of the vanes (12) in the respective actuated pressure chamber of the device (1).

7 Claims, 4 Drawing Sheets

DEVICE FOR CHANGING THE CONTROL TIMING OF THE GAS EXCHANGE VALVES OF AN INTERNAL COMBUSTION ENGINE, IN PARTICULAR A HYDRAULIC CAMSHAFT ADJUSTMENT DEVICE OF THE ROTARY PISTON TYPE

BACKGROUND

The invention relates to a device for changing the control timing of gas exchange-valves of an internal combustion engine, and it is particularly advantageous for application in hydraulic camshaft adjusting devices of the rotary piston type.

A device of this type is already known from European patent EP 0 816 610A2, which generally defines this class. This device, designed as a so-called vane-cell positioner, is formed essentially of a drive gear directly connected to a crankshaft of the internal combustion engine and an impeller that is directly connected to a camshaft of the internal combustion engine. The drive gear has a cavity formed by a hollow cylindrical perimeter wall and two sidewalls, inside of which five hydraulic working chambers are formed from five boundary walls. Accordingly, the impeller has at the perimeter of its wheel hub five vanes, each of which extends radially into a working chamber of the drive gear. These five vanes divide each of the working chambers into two counteracting hydraulic pressure chambers. The outer end of each vane of the impeller is radially pressed against the inside of the perimeter wall of the drive gear from the force of a spring element located in an axial retaining notch at the inner end of the vane. This seals off the pressure chambers of each hydraulic working chamber from one another and effects, by selectively or simultaneously applying pressure using a hydraulic pressure medium, a pivoting motion or a fixing of the impeller with respect to the drive gear and thus the camshaft with respect to the crankshaft.

The disadvantage in this known device is that when pressure is applied to one or both pressure chamber(s) of each hydraulic working chamber, a buildup of pressure results in the sealing gap between the outer end of each vane and the inside of the perimeter wall of the drive gear. If the force of the pressure exceeds the value of the spring force of the spring element located at the inner end of each vane, a so-called "vane dipping" can occur despite these spring elements, i.e. the vane can radially shift against the force of the spring element. This then results in increased pressure medium leakage between the individual pressure chambers of the hydraulic working chamber so that a poorer hydraulic lock of the impeller with respect to the drive gear results. Moreover, this increased pressure medium leakage is the cause of larger deviations in the prescribed positioning angle between the camshaft and the crankshaft as well as of slower positioning times of the device.

SUMMARY

The object of this invention is to provide a device for changing the control timing of gas exchange valves of an internal combustion engine, in particular a hydraulic camshaft adjustment device of the rotary piston type, whereby the radial shift of the vanes against the force of their spring elements resulting from the pressure buildup in the sealing gap between the outer end of each vane of the impeller and the inside of the perimeter wall of the drive gear is effectively eliminated.

According to the invention, this object is met by a device having a drive gear adapted to be directly connected to a crankshaft of the internal combustion engine and an impeller adapted to be directly connected to a camshaft of the internal combustion engine, with the drive gear having a cavity formed by a hollow cylindrical perimeter wall and two side walls inside of which at least one hydraulic working chamber is formed from at least two boundary walls. The impeller has a wheel hub with at least one vane at the perimeter thereof extending radially into a working chamber of the drive gear that divides the chamber into two respective hydraulic pressure chambers that counteract one another. An outer end of each vane of the impeller is radially pressed against the perimeter wall of the drive gear as a result of force of a spring element located in an axial retailing notch at an inner end of the vane. The pressure chambers are adapted to effect a pivoting motion or a fixing of the impeller with respect to the drive gear, and thus of the camshaft with respect to the crankshaft, by selective or simultaneous application of pressure with a hydraulic medium. The spring elements at the inner end of the vanes have a spring force, at constant space requirements, that is higher than the maximum pressure force by the hydraulic pressure medium acting on the outer end of the vanes in the respective actuated pressure chamber of the device.

The maximum pressure force of the hydraulic pressure medium is equal to the pressure peaks that arise according to operation and act on one or the other axial side of the outer ends of the vanes according to which pressure chamber of the device is actuated. Also, when both pressure chambers are simultaneously actuated, these pressure peaks act on the entire surface area of the outer ends of the vanes. However, since the spring force of the spring elements is aided by the centrifugal forces acting on the vanes when the engine is running as well as by the pressure force of the hydraulic pressure medium that also acts on half or all of the surface of the inner ends of the vanes, it has proven to be sufficient in preventing the disadvantageous vane dipping if the spring elements have a minimum spring force that is approximately equal to the maximum pressure force of the hydraulic pressure medium. The implementation of this minimum spring force by appropriately dimensioning the spring elements is, however, subject to certain limits due to the generally very limited space in the retaining notches of the spring elements.

One way to nevertheless increase the spring force of the spring elements to the required minimum spring force is the special geometric structuring of the spring elements along their axial length. In a first preferred embodiment, the spring elements are therefore provided as radially wave-shaped bent spring packets made of at least two flat profile springs that each have a concave center and two convex ends along their axial length. However, up to a limit determined by space requirements, it is also possible to arrange more than two of these types of flat profile springs on top of one another that are connected together an adhesive or the like to make installation easier. The concave center of these spring packets lies preferably on the base of the notch of the axial retaining notches of the vanes, whereas their convex ends lie against the axial edges of the inner ends of the vanes. It is, however, also possible to place the spring packets in reverse into the retaining notches of the vanes so that each of the spring packets' center lies against the inner end of the vane and the ends of the spring packets lie on the base of the notch of the retaining notch of the vane.

A second preferred embodiment of geometrically spring-force enhanced spring elements is the suggestion of providing the spring elements as radial wave-shaped bent round profile springs with at least two spring sides running parallel with one another, each of which also has a concave center and two convex ends along its axial length. The number of spring sides running next to one another, however, is also subject to limits of space requirements in this embodiment as well, for which the concave center of the round profile springs is also preferred to lie on the base of the notch of the axial retaining notches and their convex ends are preferred to lie against the inner ends of the vanes.

A third embodiment whose goal is to equip spring elements of the vanes with the required minimum spring force using special geometric shapes provides the spring elements as radial Z-shaped bent riser, upright springs. These upright springs each include an axially straight, eyelet-shaped base and a head that is parallel to it and similarly shaped, which are connected together through a slanted spring stem. The base of these upright springs lies flat on the base of the notch of the axial retaining notches, whereas its head lies flat against the inner ends of the vanes. The special advantage of these types of springs is that they apply a relatively large contact force on the vanes and at the same time can smooth out larger tolerance differences.

A fourth preferred embodiment of geometrically spring-force enhanced spring elements is suggested in which they are provided as radial convex bent hairpin springs whose spring sides are positioned parallel one on top of the other and lying against one another and are connected together through a hairpin eyelet. One end of this hairpin spring formed by the hairpin eyelet and its opposite other end are placed in the axial retaining notches on the base of the notch of the axial retaining notches, whereas its center lies against the center of the inner end of the vane. It would also be conceivable, however, to have a reverse arrangement of springs in the axial retaining notches of the vanes.

A fifth preferred embodiment of geometrically spring-force enhanced spring elements is suggested in which the spring elements are provided as loose coil springs that have approximately twice the axial length as the axial retaining notches of the vanes and are placed into the retaining notches of the vanes as a continuous loop that is radially compacted. Here, the high radial spring force of the individual spring windings of coil springs is used mainly to be able to apply a large contact force onto the vanes.

Finally, a sixth preferred embodiment of geometrically spring-force enhanced spring elements is suggested in which the spring elements are provided as spring cushions made of an elastic temperature resistant material. These spring cushions correspond in length and width approximately with the dimensions of the axial retaining notches of the vanes and have a height that is a bit larger than the distance between the base of the notch of the axial retaining notches and the inner ends of the vanes lying against the perimeter wall of the drive gear. The higher the spring cushions are designed, the higher the contact force that is applied to the vanes. As material for the spring cushions, rubber or elastomers have proven to be especially advantageous, but foam plastics or the like can also be used.

The device according to the invention for changing the control timing of gas exchange valves of an internal combustion engine, in particular a hydraulic camshaft adjustment device of the rotary piston type, has the advantage in comparison to known devices from the state of the art in that spring elements located at the inner end of the vanes exhibit, in all embodiments described, a sufficient minimum spring force to prevent the radial shift of the vanes resulting from the pressure buildup in the sealing gap between the outer end of each vane of the impeller and the inside of the perimeter wall of the drive gear. This reduces the internal pressure medium leakage between the individual pressure chambers of the hydraulic working chambers to a minimum and improves the hydraulic locking of the impeller with respect to the drive gear as well as the maintaining of prescribed positioning angles between the camshaft and the crankshaft.

Moreover, the enhanced spring elements according to the invention are not just suitable for pressing the vanes of the impeller against the perimeter wall of the drive gear of a vane-cell positioning device, but are also applicable as spring element sealing strips to an impeller of a so-called pivoting vane positioning device.

BRIEF DESCRIPTION OF THE DRAWINGS

The invention is explained in more detail below with reference to the preferred embodiments. In the associated drawings, the following is shown.

DETAILED DESCRIPTION OF THE PREFERRED EMBODIMENTS

Figure 1:
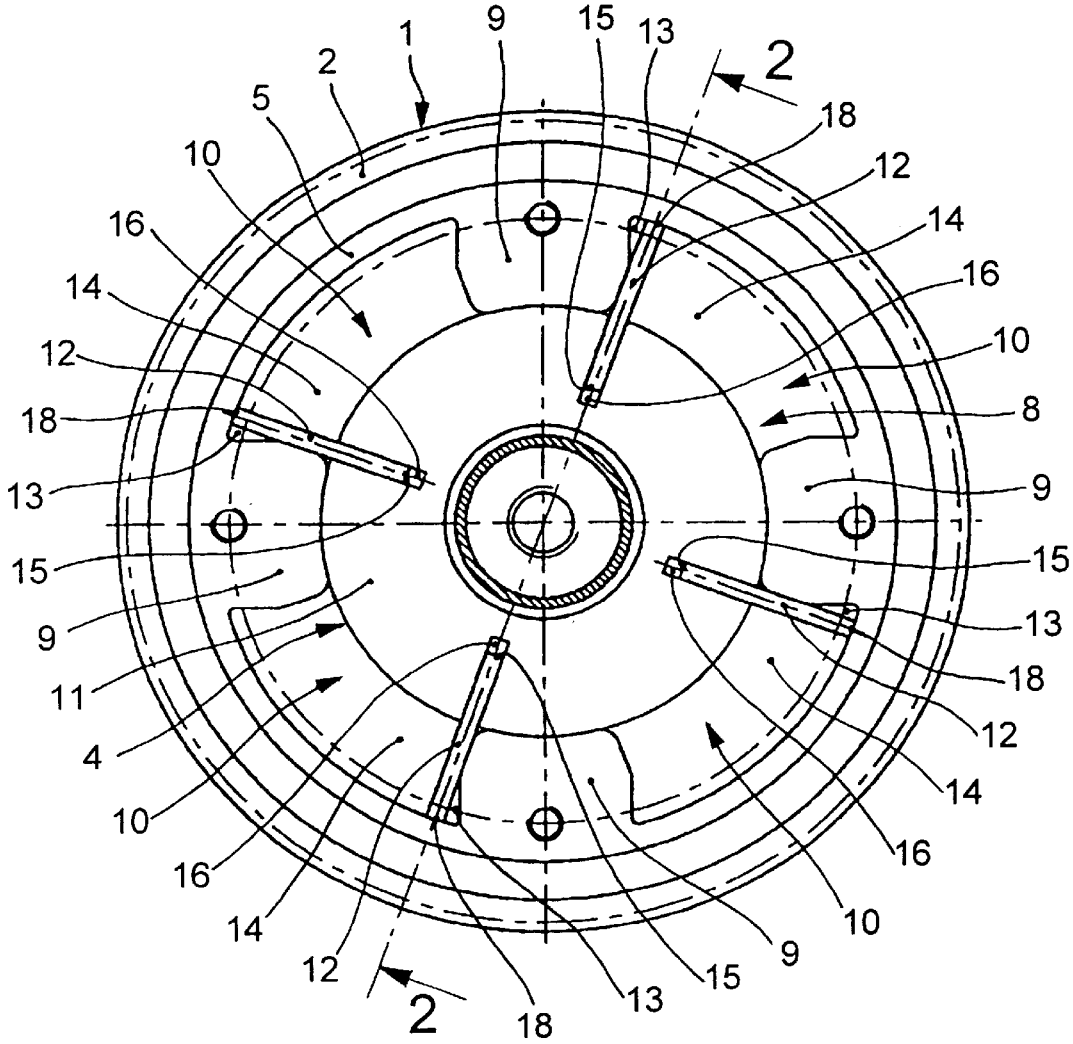
FIG. 1 is a cross-section taken along line 1—1 of FIG. 2 through a camshaft adjustment device according to the invention.
Figure 2:
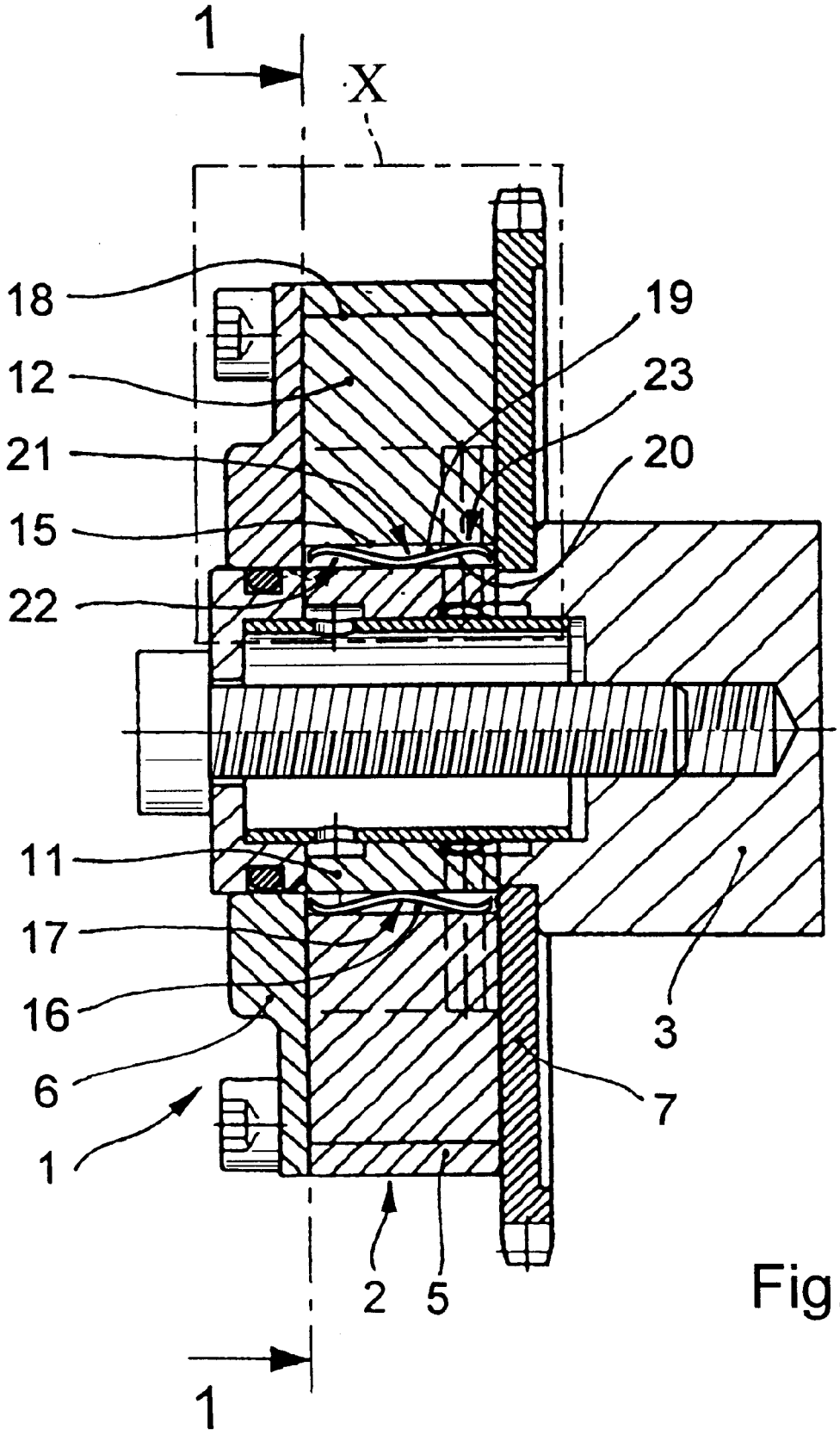
FIG. 2 is a longitudinal section taken along line of 2—2 of FIG. 1 with a first embodiment of a camshaft adjustment device according to the invention.

FIGS. 1 and 2 clearly show a device 1 designed as a hydraulic camshaft adjustment device of the rotary piston type that is used to change the control timing of gas exchange valves of an internal combustion engine. This device 1 is focused from a drive gear 2 directly connected to a crankshaft (not shown) of an internal combustion engine and of an impeller 3 directly connected to a camshaft of the internal combustion engine. The drive gear 2 has a cavity 8 formed from a hollow cylindrical perimeter wall 5 and two sidewalls 6, 7, inside of which four hydraulic working chambers 10 are formed from four boundary walls 9. The impeller 4 at the perimeter of its wheel hub 11 includes four vanes 12 that extend radially into the working chambers 10 of the drive gear 2. These vanes divide each of the working chambers 10 into two hydraulic pressure chambers 13, 14 that counteract each other. It can be clearly seen in FIG. 2 that the outer end 18 of each vane 12 of the impeller 4 is radially pressed against the inside of the perimeter wall 5 of the drive gear 2 by the force of a spring element located in an axial retaining notch 16 at its inner end 15 so that the pressure chambers 13, 14 are sealed off from one another. By selectively or simultaneously applying pressure using a hydraulic pressure medium, a pivoting or fixing of the impeller 4 with respect to the drive gear 2, and thus of the camshaft with respect to the crankshaft, is effected.

In order to prevent "vane dipping", which results from the pressure buildup in the sealing gap between the outer end 18 of each vane 12 and the inside of the perimeter wall 5 of the drive gear 2 when pressure is applied to one or both pressure chamber(s) 13, 14 of each hydraulic working chamber 10 of the device 1, the spring elements 17 located on the inside end 15 of the vane 12 are, according to the invention, designed with a spring force at unchanged space requirements that is higher than the maximum pressure force of the hydraulic pressure medium in the respective activated pressure chamber 13, 14 of the device acting on the outside end 18 of the vane 12.

This is realized in the first embodiment shown in FIG. 2 of a device according to the invention by pivoting the spring elements 17 as radial wave-shaped bent spring packets made of two flat profile springs 19, 20 that each have a concave center 21 and two convex ends 22, 23, along their axial length. In so doing, the concave center 21 of these spring packets lies at the base of the notch of the axial retaining notches 16 of the vanes 12, whereas the convex ends 22, 23 lie at the inner ends 15 of the vanes.

Figure 3:
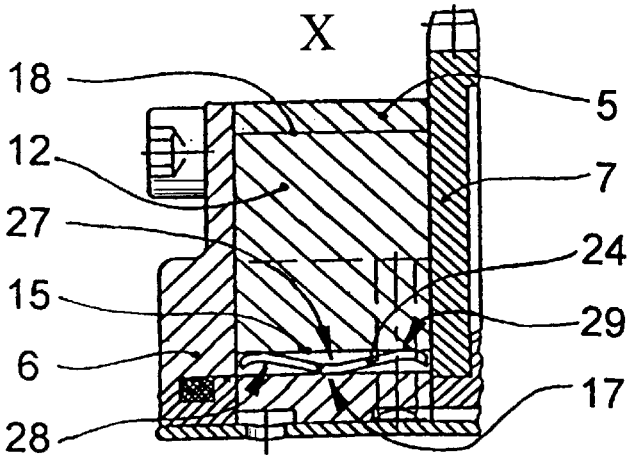
FIG. 3 is a detail view of the area X in FIG. 2 with a second embodiment of a camshaft adjustment device according to the invention.
Figure 3A:
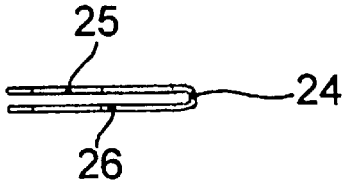
FIG. 3A is a top view of a first embodiment of the spring shown in FIG. 3.
Figure 3B:
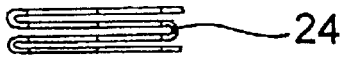
FIG. 3B is a top view of a second embodiment of the spring shown in FIG. 3.

A second embodiment of a device 1 according to the invention is shown in FIG. 3. In this embodiment, the spring elements 17 are provided as radial wave-shaped bent round profile springs 24 that also have a concave center 27 lying at the base of the notch of the axial retaining notch 16 along its axial length, and two convex ends 28, 29 lying against the inner ends 15 of the vanes 12. The top views of these round profile springs 24 in FIGS. 3A and 3B clarifies that they are designed with at least two spring sides 25, 26 running parallel next to one another, wherein their number can be expanded in the manner indicated below up to a limit determined by available space.

Figure 4:
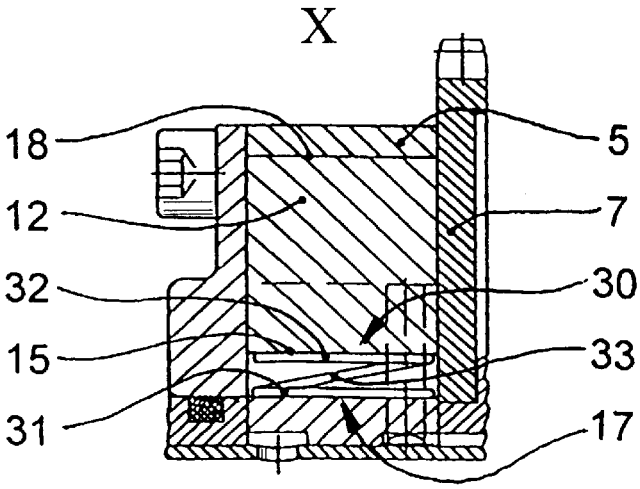
FIG. 4 is a detail view of the area X in FIG. 2 with a third embodiment of a camshaft adjustment device according to the invention.
Figure 4A:
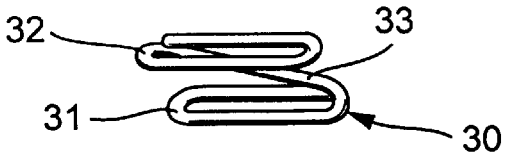
FIG. 4A is an isometric view of the spring shown in FIG. 4.

In the third embodiment shown in FIG. 4 of a device 1 according to the invention, the spring elements 17 are provided as Z-shaped bent riser, upright springs 30 that are also depicted as individual parts in perspective representation. It is clear from FIG. 4A that the upright springs 30 include an axially straight, eyelet-shaped base 31 and a head 32 running parallel to it and formed in a similar manner, which are connected through a slanted spring stem 33.

Figure 5:
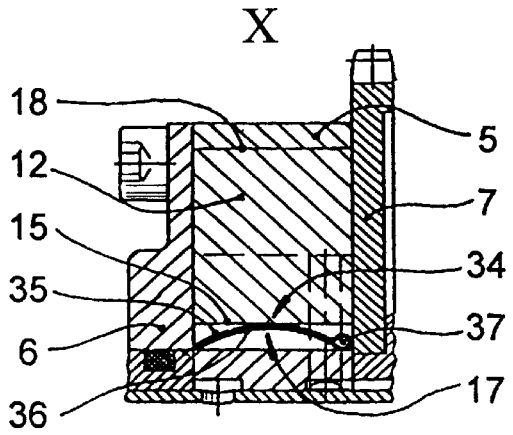
FIG. 5 is a detail view of the area X in FIG. 2 with a fourth embodiment of a camshaft adjustment device according to the invention.

A fourth embodiment of a device 1 according to the invention is shown in FIG. 5. In this representation, it is clear to see that the spring elements 17 are provided as convex bent hairpin springs 34 whose spring sides 35, 36 that are located parallel, one on top of the other, and lying against one another, and are connected to one another through a hairpin eyelet 37. One end formed by the hairpin eyelet 37 and the opposite other end of this hairpin spring 34 lie on the base of the notch of the axial retaining notches 16 of the vanes 12 so that their convex center can lie against the inner end 15 of the vanes 12.

Figure 6:
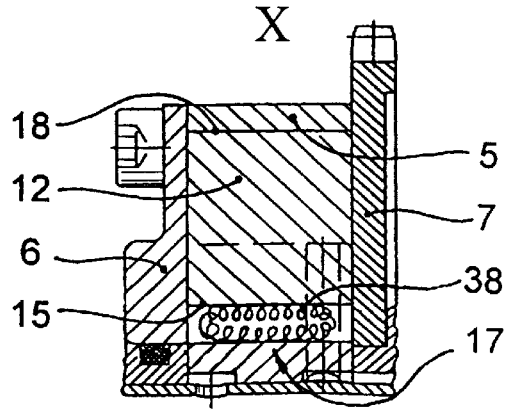
FIG. 6 is a detail view of the area X in FIG. 2 with a fifth embodiment of a camshaft adjustment device according to the invention.

As the fifth embodiment of a device 1 according to the invention, FIG. 6 shows an embodiment in which the spring elements 17 are provided as loose coil springs 38. These coil springs 38 have approximately twice the axial length as the axial retaining notches 16 of the vanes 12 and are placed into the axial retaining notches 16 of the vanes 12 as a continuous loop radially compacted in the manner shown in the drawing.

Figure 7:
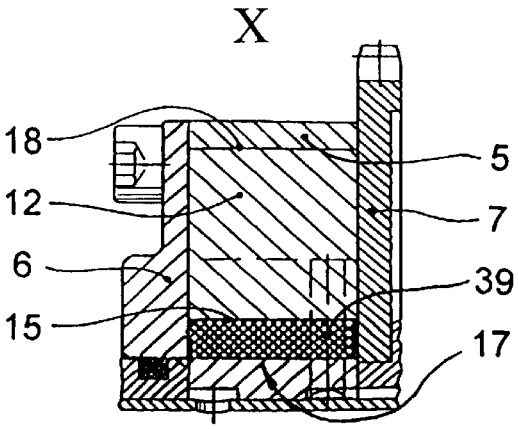
FIG. 7 is a detail view of the area view X in to FIG. 2 with a sixth embodiment of a camshaft adjustment device according to the invention.

In FIG. 7, a sixth embodiment of the device 1 according to the invention is shown in which the spring elements 17 are provided as spring cushions 39 made of elastic, temperature resistant rubber. These spring cushions 39 correspond in length and width approximately with the dimensions of the axial retaining notches 16 of the vanes 12 and have a height that is a bit larger than the distance between the base of the notch of the axial retaining notches 16 and the inner ends 15 of the vanes 12 lying against the perimeter wall 4 of the drive gear 2.

| Reference List | |
|---|---|
| 1 | Device |
| 2 | Drive gear |
| 3 | Camshaft |
| 4 | Impeller |
| 5 | Perimeter wall |
| 6 | Side wall |
| 7 | Side wall |
| 8 | Cavity |
| 9 | Boundary walls |
| 10 | Hydraulic working chamber |
| 11 | Wheel hub |
| 12 | Vane |
| 13 | Pressure chamber |
| 14 | Pressure chamber |
| 15 | Inner end |
| 16 | Axial retaining notch |
| 17 | Spring elements |
| 18 | Outer end |
| 19 | Flat profile spring |
| 20 | Flat profile spring |
| 21 | Center |
| 22 | End |
| 23 | End |
| 24 | Round profile spring |
| 25 | Spring sides |
| 26 | Spring sides |
| 27 | Center |
| 28 | End |
| 29 | End |
| 30 | Riser (upright) springs |
| 31 | Base |
| 32 | Head |
| 33 | Spring stem |
| 34 | Hairpin spring |
| 35 | Spring sides |
| 36 | Spring sides |
| 37 | Hairpin eyelet |
| 38 | Coil spring |
| 39 | Spring cushions |

What is claimed is:

1. A device for changing the control timing of gas exchange valves of an internal combustion engine, comprising:

a drive gear (2) adapted to be directly connected to a crankshaft of the internal combustion engine and an impeller (4) adapted to be directly connected to a camshaft (3) of the internal combustion engine, the drive gear (2) has a cavity (8) formed by a hollow cylindrical perimeter wall (5) and two side walls (6, 7) inside of which at least one hydraulic working chamber (10) is formed from at least two boundary walls (9), the impeller (4) has a wheel hub (11) with at least one vane (12) at the perimeter thereof extending radially into a working chamber (10) of the drive gear (2) that divides the chamber into two respective hydraulic pressure chambers (13, 14) that counteract one another, an outer end (18) of each vane (12) of the impeller (4) is radially pressed against the perimeter wall (5) of the drive gear (2) as a result of force of a spring element

(17) located in an axial retaining notch (16) at an inner end (15) of the vane, the pressure chambers (13, 14) adapted to effect a pivoting motion or a fixing of the impeller (4) with respect to the drive gear (2), and thus of the camshaft (3) with respect to the crankshaft, by selective or simultaneous application of pressure with a hydraulic medium, wherein, the spring elements (17) located at the inner end (15) of the vanes (12) have, at unchanged space requirements, a spring force that is higher than a maximum pressure force of the hydraulic medium acting on the outer end (18) of the vanes (12) in the associated actuated pressure chamber (13, 14) of the device (1).

2. A device according to claim 1, wherein the spring elements (17) comprise radial, wave-shaped, bent spring packets made of at least two flat profile springs (19, 20) that have a concave middle (21) and two convex ends (22, 23) along an axial length thereof.

3. A device according to claim 1, wherein the spring elements (17) comprise radial, wave-shaped, bent round profile springs (24) with at least two spring sides (25, 26) that extend parallel next to one another and that have a concave center (27) and two convex ends (28, 29) along an axial length thereof.

4. A device according to claim 1, wherein the spring elements (17) comprise radial Z-shaped bent riser, upright springs (30) that each includes an axially straight, eyelet-shaped base (31) and an axially straight, eyelet-shaped head (32) extending parallel to the base, which are connected together by a slanted spring stem (33).

5. A device according to claim 1, wherein the spring elements (17) comprise radial convex bent hairpin springs (34) having spring sides (35, 36) that are located parallel one on top of the other and lying against one another that are connected together by a hairpin eyelet (37).

6. A device according to claim 1, wherein the spring elements (17) comprise lose coil springs (38) that have approximately twice an axial length as an axial retaining notch (16) length of the vanes (12) and can be placed as a continuous loop that is radially compacted into the retaining notches (16) of the vanes (12).

7. A device according to claim 1, wherein the spring elements (17) comprise spring cushions (39) made of an elastic, temperature resistant material that has a length and width that corresponds to a length and width approximately of the axial retaining notches (16) of the vanes (12) and has a height that is a bit larger than a distance between the base of the notch of the axial retaining notches (16) and the inner end (15) of the vanes (12).

* * * * *